United States Patent [19]

Angelov et al.

[11] Patent Number: 4,498,971

[45] Date of Patent: Feb. 12, 1985

[54] SEPARATION OF BITUMINOUS MATERIAL FROM OIL SANDS AND HEAVY CRUDE OIL

[75] Inventors: Georgi Angelov, Don Mills; Paul W. M. Shibley, Oshawa, both of Canada

[73] Assignee: Bitumen Development Corporation Limited, Toronto, Canada

[21] Appl. No.: 507,241

[22] Filed: Jun. 23, 1983

[30] Foreign Application Priority Data

Jul. 5, 1982 [GB] United Kingdom ..... 8219359

[51] Int. Cl.[3] ..... C10G 1/04

[52] U.S. Cl. ..... 208/11 LE; 208/8 LE; 208/309; 208/311; 208/337

[58] Field of Search ..... 208/11 LE, 8 LE, 309, 208/311, 337

[56] References Cited

U.S. PATENT DOCUMENTS 3,114,694 12/1963 Bergougnou et al. ..... 208/11 LE 3,334,043 8/1967 Ferris et al. ..... 208/11 LE

*Primary Examiner*—Delbert E. Gantz

*Assistant Examiner*—A. Pal

*Attorney, Agent, or Firm*—Robert F. Delbridge; Arne I. Fors

[57] ABSTRACT

A process for the separate recovery of oil and asphaltene/polar components from oil and asphaltene/polar bearing sand-containing material includes cooling the material to a temperature at which the material behaves as a solid, crushing the material at such a temperature to produce relatively coarse particles containing a major proportion of the sand and oil and relatively fine particles containing a major proportion of the asphaltenes and polars, and mechanically separating the relatively coarse particles from the relatively fine particles at such a temperature. The relatively coarse particles are treated to recover oil, and the relatively fine particles are treated to recover asphaltenes and polars. Similar processes are desirable for the treatment of heavy crude oil which may or may not contain sand.

14 Claims, 1 Drawing Figure

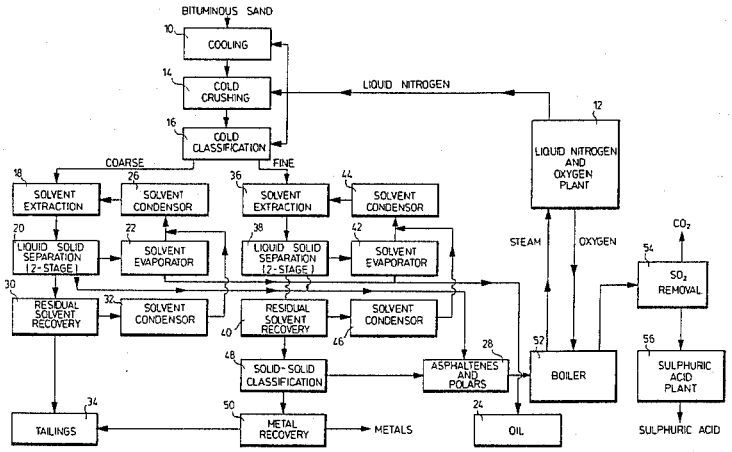

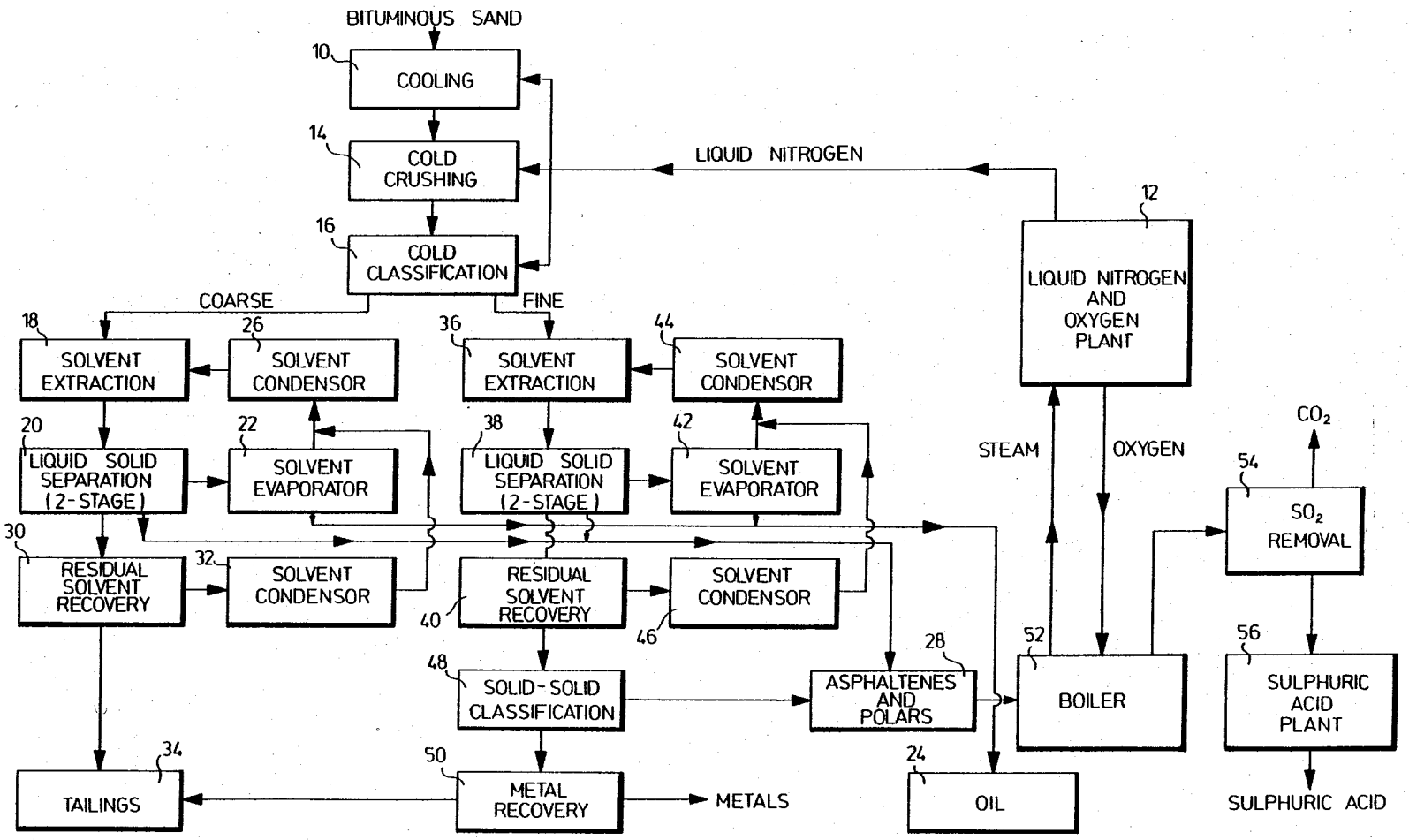
BITUMINOUS SAND
COOLING
10
COLD CRUSHING
14
COLD CLASSIFICATION
16
FINE
COARSE
LIQUID NITROGEN
LIQUID NITROGEN AND OXYGEN PLANT
12
OXYGEN
STEAM
BOILER
52
$SO_2$ REMOVAL
54
$CO_2$
SULPHURIC ACID PLANT
56
SULPHURIC ACID
OIL
24
ASPHALTENES AND POLARS
28
SOLVENT EXTRACTION
36
LIQUID SOLID SEPARATION (2-STAGE)
38
SOLVENT EVAPORATOR
42
SOLVENT CONDENSOR
44
RESIDUAL SOLVENT RECOVERY
40
SOLVENT CONDENSOR
46
SOLID-SOLID CLASSIFICATION
48
METAL RECOVERY
50
METALS
SOLVENT EXTRACTION
18
LIQUID SOLID SEPARATION (2-STAGE)
20
SOLVENT EVAPORATOR
22
SOLVENT CONDENSOR
26
RESIDUAL SOLVENT RECOVERY
30
SOLVENT CONDENSOR
32
TAILINGS
34

SEPARATION OF BITUMINOUS MATERIAL FROM OIL SANDS AND HEAVY CRUDE OIL

This invention relates to the separate recovery of oil and other components from sand-containing material, and heavy crude oil which may or may not contain sand.

Oil sands comprise sand particles covered with bituminous material formed by oil, asphaltenes and polars. Typical oil sands may contain from about 10 to about 20% by weight bituminous material and from about 80 to about 90% by weight sand, with the sand particles being from about 150 to 40 mesh (100 to 350 microns) in size.

Various processes have been used or suggested for effecting separation of bituminous material from the sand particles. At the present time, the usual commercial practice is to use a hot separation process. However, such processes are not entirely satisfactory due to the large capital investment required, high energy requirement for operation, and environmental and operating problems. Attempts have been made to develop alternative processes, such as solvent extraction processes, but such other processes also possess at least some of the previously mentioned disadvantages.

Attempts have also been made to separate bituminous material from oil sands by cooling the oil sands below the glass point of the bituminous material, grinding the cooled sands to cause the bituminous material to break away as bituminous particles from the sand particles, with the bituminous particles being substantially smaller than the sand particles, and without the sand being reduced in size to any significant extent, and separating the smaller cooled bituminous particles from the larger sand particles. However, the amount of separation of bituminous material from sand particles obtainable by such low temperature processes have not been sufficient to render such a process commercially viable.

The present invention is based on the discovery that it is possible to effect separate recovery of oil and asphaltene and polar components from oil sand material by cooling the material to a temperature at which the material behaves as a solid, crushing the material at a temperature at which the material behaves as a solid to produce relatively coarse particles containing a major proportion of the sand and oil and relatively fine particles containing a major proportion of the asphaltenes and polars, mechanically separating the relatively coarse particles from the relatively fine particles at a temperature at which the material behaves as a solid, treating the relatively coarse particles to remove oil, and treating the relatively fine particles to remove asphaltenes and polars.

The process may include treating the relatively coarse particles with a solvent extraction agent which dissolves oil, separating oil containing solvent extraction agent from the sand, and recovering oil from the solvent extraction agent.

The process may also include treating the relatively fine particles with a solvent extraction agent which dissolves asphaltenes and polars, separating asphaltene and polar containing solvent extraction agent from fine sand, and recovering asphaltenes and polars from the solvent extraction agent.

Advantageously, the process also includes burning recovered asphaltenes and polars to provide energy, using at least some of the energy to operate a plant for producing liquid nitrogen and oxygen, using the liquid nitrogen to achieve the cooling of the material. and using the oxygen in the burning of recovered asphaltenes and polars. The burning of the asphaltenes and polars produces off-gases containing sulphur dioxide, and the process may therefore also advantageously include using the sulphur dioxide in the production of sulphuric acid.

The material may be cooled to a temperature in the range of from about minus 10° to about minus 180° C., preferably a temperature in the range of from about minus 30° to about minus 70° C.

The relatively coarse particles may be treated with a solvent extraction agent, such as naphtha, preferably at about room temperature, to effect dissolution of oil and entrained asphaltenes and polars. The oil and entrained asphaltenes and polars may then be recovered from the solvent extraction agent, and the entrained asphaltenes and polars then separated from the oil.

The relatively coarse particles may alternatively be treated with a solvent extraction agent, preferably at a temperature in the range of from about minus 30° C. to about minus 70° C. to effect dissolution of oil without substantial dissolution of entrained asphaltenes and polars. In this case, the solvent extraction agent may be hexane, pentane, butane, propane or mixtures thereof. The oil containing solvent extraction agent and entrained asphaltenes and polars may be separated from the sand, with the entrained asphaltenes and polars then being separated from the oil containing solvent extraction agent.

The relatively fine particles may be treated with a solvent extraction agent such as naphtha, preferably at about room temperature, to effect dissolution of asphaltenes and polars and entrained oil. The asphaltenes and polars and entrained oil may be recovered from the solvent extraction agent, with the entrained oil then being separated from the asphaltenes and polars.

The relatively fine particles may alternatively be treated with a solvent extraction agent, preferably at a temperature in the range of from about minus 30° C. to about minus 70° C. to effect dissolution of entrained oil, without substantial dissolution of asphaltenes and polars. Such a solvent extraction agent may be hexane, pentane, butane, propane or mixtures thereof. The asphaltenes and polars may then be separated from the oil containing solvent extraction agent.

It has also been discovered that the invention may be used to effect separate recovery of oil and asphaltene and polar components from sand-containing heavy crude oil.

Further, it has been discovered that the invention may be used to effect separate recovery of oil and asphaltene and polar components from heavy crude oil which contains substantially no sand. In this case, the process may comprise cooling the heavy crude oil to a temperature below the glass point of the oil, crushing the cooled heavy crude oil at a temperature below said glass point to produce relatively fine particles, treating the fine particles with a solvent extraction agent to dissolve oil without substantial dissolution of asphaltenes and polars, separating oil containing solvent extraction agent from the asphaltenes and polars, and recovering oil from the solvent extraction agent.

One embodiment on the invention will now be described by way of example, with reference to the accompanying drawing which shows a flow diagram of a process for recovering oil and asphaltenes and polars from bituminous sands.

BRIEF DESCRIPTION OF DRAWINGS

Referring to the drawing, butuminous sands are first cooled in a refrigeration step 10 to a temperature at which the material becomes solid, preferably in the range of from about minus 10° to about minus 180° C., more preferably in the range of from about minus 30° to about minus 70° C. using liquid nitrogen from a liquid nitrogen plant 12 which will be referred to in more detail later. The cooled bituminous sands then proceed to a crushing step 14 where they are lightly crushed, for example by a hammer mill, with the low temperature being maintained by liquid nitrogen from the liquid nitrogen plant 12. During the cold crushing step 14, oil coated sand particles break away from one another, and fine asphaltene and polar particles break away from the sand. The cold crushing step 14 is conducted in such a manner that the original size of the sand particles is not substantially reduced.

The crushed mixture is then passed to a classification step 16 where particles smaller than about 100 mesh (150 microns) are separated from larger particles, with the low temperature again being maintained by liquid nitrogen from the liquid nitrogen plant 12. The fine fraction will typically be about 25% of the weight of the original bituminous sands and contain about 75% of the bitumen. The coarse fraction will typically contain about 75% of the weight of the original bituminous sands and contain about 25% of the bitumen.

The coarse fraction (containing much of the oil and a minor proportion of asphaltenes and polars) then proceeds to a solvent extraction step 18 where the bituminous content is extracted by use of pentane at minus 30° to minus 70° C. to dissolve oil and not the asphaltenes or polars. Because of the high surface area of the particles created by the cold crushing step 14, the solvent extraction step 18 proceeds in a relatively fast manner. The resultant mixture of asphaltenes, polars, sand and oil-containing solvent proceeds to a two-stage liquid/solid centrifugal separation step 20. In the first stage, the solvent, asphaltenes and polars are decanted from the sand, and in the second stage the oil-containing solvent is separated from the asphaltenes and polars, with most of the solvent passing to a solvent evaporation step 22. The solvent is evaporated in a solvent evaporation step 22, leaving the oil which is passed to an oil receptacle 24. The evaporated solvent is condensed in a solvent condenser 26 for subsequent re-use in the solvent extraction step 18.

The asphaltenes and polars proceed to an asphaltene or polar receptacle 28, and the sand particles with the remaining solvent pass to a residual solvent recovery step 30 where the remaining solvent is evaporated. The evaporated solvent from this step is condensed in a solvent condenser 32, and the condensed solvent returned to the solvent condenser 26 for subsequent re-use in the solvent extraction step 18. The resultant tailings from the residual solvent recovery step 30 pass to a tailings receptacle 34.

The fine fraction (containing most of the asphaltenes and polars and a minor proportion of the oil) from the cold classification step 16 is passed to a solvent extraction step 36 where the oil content is extracted with pentane at minus 30° to minus 70° C. to dissolve oil and not the asphaltenes or polars. Because of the high surface area of the particles created by the cold crushing step 16, the solvent extraction step proceeds in a relatively fast manner. The resultant mixture of asphaltenes, polars, sand and solvent proceeds to a two-stage liquid/solid centrifugal separation step 38. In the first stage, the sand is recovered with low centrifugal forces, and in the second stage, higher centrifugal forces are used to recover the asphaltenes, polars and fine sand/silt. The asphaltenes and polars are dried and passed to the asphaltene and polar receptacle 28, and the sand and remaining solvent are passed to a residual solvent recovery step 40.

The separated oil-containing solvent proceeds to a solvent evaporator 42 from which the resultant oil is passed to the oil receptacle 24, and evaporated solvent proceeds to a solvent condenser 44 for subsequent re-use in the solvent extraction step 36.

In the residual solvent recovery step 40, the remaining solvent is evaporated and passed to a solvent condenser 46 for return to the solvent condenser 44. Sand and remaining asphaltenes and polars from the residual solvent recovery step 40 proceed to a solid-solid classification step 48 from which the separated asphaltenes and polars are passed to the asphaltene and polar receptacle 28. It has been found that the remaining solids may contain significant concentrations of metals such as nickel and titanium, so that these solids may be treated in any convenient manner to recover such metals in a metal recovery step 50, with the remaining tailings being passed to the tailings receptacle 34.

The oil collected in the oil receptacle 24 can be utilized in any desired manner. The asphaltenes and polars are burned in a boiler 52 to provide steam for use in the liquid nitrogen plant 12 which also produces oxygen, the oxygen being utilized in the boiler 52 to effect adequate combustion of the asphaltenes and polars. The burning of the asphaltenes and polars also produces sulphur dioxide gas which also contains carbon dioxide. The sulphur dioxide is removed by cooling in a sulphur dioxide removal step 54 and is used to produce sulphuric acid in a sulphuric acid plant 56.

In some cases, it may be advantageous to subject the coarse particles to a further cold crushing step and a further cold classification step to separate coarse particles from fine particles. Coarse particles obtained in this manner may comprise sand and oil, with substantially no asphaltenes and polars, and the oil will be easily recovered by solvent extraction or by flashing. The further fine particles may be treated with the fine particles from the first cold classification step.

Examples of the invention as so far described are as follows:

EXAMPLE 1

Bituminous sands from the Athabasca tar sands in Alberta, Canada were cooled to minus 60° C. by use of solid carbon dioxide. The cooled sands were then crushed and subsequently screened on a 100 mesh (150 microns) screen. The coarse fraction was 71% of the original weight of the sands and contained 30% of the bitumen, the ratio of oils to asphaltenes and polars being 65%. The fine fraction was 29% of the original weight of the sands and contained 70% of the bitumen, the ratio of oils to asphaltenes and polars being 45%.

EXAMPLE 2

A sample of the coarse fraction from Example 1 was treated with hexane solvent at minus 30° C. for five minutes. The specific gravity of the sand was 2.7 and that of the asphaltenes and polars was 1.1, with the specific gravity of hexane being 0.65. Thus, the asphaltenes and polars were readily decanted with the solvent, leaving relatively clean sand. It was found that at this temperature the asphaltenes and polars absorbed a minimum amount of solvent and filtered easily. It was also found that any traces of asphaltenes and polars remaining with the solvent after decantation were free and solid at ambient temperature and therefore readily separable by filtration. The hexane was distilled off leaving oil as residue. Thus, virtually all of the oil and all of the asphaltenes and polars could readily be removed from the coarse fraction.

EXAMPLE 3

A sample of the fine fraction from Example 1 was also treated with hexane solvent at minus 30° C. for 5 minutes. In this case, a higher ratio of solvent was used, since it was found that the finer sands and higher proportion of asphaltenes and polars separated better in a lower density solution. Similar decantation and filtration was also used with this sample.

After decantation, 30% of the asphaltenes and polars remained with the fine sand as solid free particles. The solvent was filtered to recover asphaltenes and polars, and the remaining solvent was then distilled off leaving oil as residue. Virtually all of the oil and 70% of the asphaltenes and polars were thus recovered. The sand residue was screened at 100 mesh (150 microns), with the minus 100 mesh fraction being asphaltenes and polars upgraded by a factor of 10.

EXAMPLE 4

Samples of the oils obtained in Examples 2 and 3 were combined and treated with pentane at minus 30° C. By filtering, 10% by weight of the samples were recovered as asphaltenes and polars which were dry and solid at room temperature. Such a step could therefore be used if desired.

EXAMPLE 5

In one test, the fine fraction sand (after removal of the oils and asphaltenes and polars represented 12% of the original weight of the bituminous sands. It was found that 40% of the titanium in the original sands were concentrated in this fine fraction sand.

EXAMPLE 6

From tests carried out in accordance with preceding examples, it was found that, using a sample of bituminous sands from the Athabasca tar sands field containing 9% carbon, oil recovered contained 83% of the carbon, recovered asphaltenes and polars contained 13% of the carbon, and unrecovered asphaltenes and polars contained 4% of the carbon. Of these unrecovered asphaltenes and polars, microscopic evaluation showed that at least two-thirds were free and solid and recoverable by simple classification techniques. Thus, recovery of carbon exceeding 98% would be possible.

As indicated earlier, the invention is also applicable to the separated recovery of oil and other components from heavy crude oil containing sand. Further, even if heavy crude oil does not contain any sand, separate recovery of oil and asphaltene and polar components can be effectively recovered therefrom by using cooling below the glass point of the oil, crushing, and solvent extraction steps in accordance with the invention, with optional cold classification between the cold crushing and solvent extraction steps. In other words, all the crushed particles may be treated as fine particles in the process illustrated in the drawing, with the provision for treatment of coarse particles therefore not being required. An example follows:

EXAMPLE 7

A heavy crude oil from Alberta, Canada was cooled, crushed and treated with pentane at minus 30° C. Of the 35 gms starting weight, 9 gms (26%) was recovered as solid asphaltenes and polars. The resultant oil product was much less viscous than the original crude.

Other embodiments and examples of the invention will be readily apparent to a person skilled in the art, the scope of the invention being defined in the appended claims.

What we claim as new and desire to protect by Letters Patent of the United States is:

1. A process for the separate recovery of oil and asphaltene/polar components from oil and asphaltene/polar bearing sand-containing material, the process comprising cooling the material to a temperature in the range of from about minus 10° to about minus 180° C. at which the material behaves as a solid, crushing the material at a temperature at which the material behaves as a solid to produce relatively coarse particles containing a major proportion of the sand and oil and relatively fine particles containing a major proportion of the asphaltenes and polars, mechanically separating the relatively coarse particles from the relatively fine particles at a temperature at which the material behaves as a solid, treating the relatively coarse particles to recover oil, and treating the relatively fine particles to recover asphaltenes and polars.

2. A process according to claim 1 including treating the relatively coarse particles with a solvent extraction agent which dissolves oil, separating oil containing solvent extraction agent from the sand and recovering oil from the solvent extraction agent.

3. A process according to claim 1 including burning recovered asphaltenes and polars to provide energy, using at least some of said energy to operate a plant for producing liquid nitrogen and oxygen, using said liquid nitrogen to achieve said cooling of the material, and using said oxygen in said burning of recovered asphaltenes and polars.

4. A process according to claim 1 wherein the material is cooled to a temperature in the range of from about minus 30° to about minus 70° C.

5. A process according to claim 2 wherein the relatively coarse particles are treated with a solvent extraction agent to effect dissolution of oil without substantial dissolution of entrained asphaltenes and polars.

6. A process according to claim 5 wherein the relatively coarse particles are treated with a solvent extraction agent at a temperature in the range of from about minus 30° C. to about minus 70° C.

7. A process according to claim 6 wherein the solvent extraction agent is selected from the group consisting of hexane, pentane, butane, propane and mixtures thereof.

8. A process according to claim 5 wherein oil containing solvent extraction agent with entrained asphaltenes and polars are separated from the sand, and the entrained asphaltenes and polars are then separated from oil containing solvent extraction agent.

9. A process according to claim 1 wherein the relatively fine particles are treated with a solvent extraction agent to effect dissolution of entrained oil without substantial dissolution of asphaltenes and polars.

10. A process according to claim 9 wherein the relatively fine particles are treated with a solvent extraction agent at a temperature in the range of from about minus 30° to about minus 70° C.

11. A process according to claim 10 wherein the solvent extraction agent is selected from the group consisting of hexane, pentane, butane, propane and mixtures thereof.

12. A process according to claim 9 wherein the asphaltenes and polars are separated from the oil containing solvent extraction agent.

13. A process according to claim 1 wherein said material comprises oil-bearing sand.

14. A process according to claim 1 wherein said material comprises sand-containing heavy crude oil.

* * * * *